US007150170B2

(12) United States Patent
Streubel et al.

(10) Patent No.: US 7,150,170 B2
(45) Date of Patent: Dec. 19, 2006

(54) APPARATUS AND PROCESS FOR HYDRAULIC HIGH-PRESSURE FORMING OF A SHEET

(75) Inventors: Wolfgang Streubel, Detmold (DE); Norbert Austerhoff, Paderborn (DE); Rafael Garcia Gomez, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 10/962,611

(22) Filed: Oct. 13, 2004

(65) Prior Publication Data

US 2005/0076691 A1 Apr. 14, 2005

(30) Foreign Application Priority Data

Oct. 14, 2003 (DE) ..... 103 47 601

(51) Int. Cl.
*B23P 23/00* (2006.01)
*B21B 37/00* (2006.01)
*B21D 22/22* (2006.01)

(52) U.S. Cl. ..... 72/57; 72/60; 29/421.1

(58) Field of Classification Search ..... 72/58, 72/60, 57, 59; 29/421.1
See application file for complete search history.

(56) References Cited

U.S. PATENT DOCUMENTS

| | | | | |
|---|---|---|---|---|
| 3,208,255 A * | 9/1965 | Burk | ..... | 72/60 |
| 3,373,585 A * | 3/1968 | Reynolds | ..... | 72/58 |
| 4,265,102 A * | 5/1981 | Shimakata et al. | ..... | 72/58 |
| 4,362,037 A * | 12/1982 | Whitfield | ..... | 72/58 |
| 6,493,913 B1 * | 12/2002 | Streubel et al. | ..... | 72/58 |
| 6,675,620 B1 * | 1/2004 | Heyll et al. | ..... | 72/57 |
| 6,708,543 B1 * | 3/2004 | Yoshioka et al. | ..... | 72/57 |
| 2001/0005929 A1 | 7/2001 | Streubel | | |

FOREIGN PATENT DOCUMENTS

| | | |
|---|---|---|
| DE | 196 24 036 A1 | 12/1997 |
| DE | 199 57 888 A1 | 6/2001 |
| DE | 10153600 A1 | 5/2003 |
| DE | 10202791 A1 | 8/2003 |
| DE | 10313072 A1 | 9/2004 |
| EP | 1136149 A2 | 9/2001 |
| ES | 2196244 T3 | 12/2003 |

* cited by examiner

*Primary Examiner*—David Jones
(74) *Attorney, Agent, or Firm*—Birch, Stewart, Kolasch & Birch, LLP

(57) ABSTRACT

An apparatus for hydraulic high-pressure forming of a sheet, the apparatus having a top tool and a bottom tool as well as at least one pressure generating unit arranged between the press ram of a mechanical press and the top tool and uses a pressurized medium from the pressure generating unit as a working fluid for hydraulic preforming of the sheet. Contact faces of the tools directly engage with the sheet surface along the clamping area thereof and act to seal off the forming area that are subjected to the working fluid solely by contact sealing.

15 Claims, 2 Drawing Sheets

APPARATUS AND PROCESS FOR HYDRAULIC HIGH-PRESSURE FORMING OF A SHEET

This nonprovisional application claims priority under 35 U.S.C. § 119(a) on German Patent Application No. DE 103 47 601.6 filed in Germany on Oct. 14, 2003, which is herein incorporated by reference.

BACKGROUND OF THE INVENTION

1. Field of the Invention

The present invention relates to an apparatus and a process for hydraulic high-pressure forming of a sheet, e.g., a blank.

2. Description of the Background Art

It has been known in the art for production of sheet metal components having a complex geometry to carry out forming with the aid of working fluids. In such a case, a working fluid pressure is applied to a sheet and the sheet is offhand formed without initially reproducing the shape of a tool on it. The sheet then gets adapted to the shape of a rigid bottom or a top tool and is brought into its desired final shape by a sizing pressure of the working fluid or by way of any conventional pressing technique (DE 196 24 036 A1). The drawbacks involved in such processes, however are very long cycle times due to the fact that the various forming steps are carried out sequentially and that pressure buildup takes place slowly. Thus, the conventional processes are not suitable for use in large-scale production of formed sheets.

Other conventional apparatus for carrying out such a process have a forming tool that includes a forming cavity defined by a bottom die and a top die. The press ram of a fixed-stroke mechanical press is connected to the top die, namely via the pressure generating unit and/or the piston/cylinder unit whose cylinder cavity is in a fluid conducting communication with the forming area of the forming tool. It is due to that arrangement that hydraulic forming may be achieved at high speed because the work piece is already being deformed under the action of the working fluid pressure from the piston/cylinder unit when the forming tool is already closed and while the press ram is still moving downward and the piston of the piston/cylinder unit is hence still descending. The hydraulic forming process is already terminated by the time the mechanical press and/or the crank of a crank press reaches its bottom dead center position.

All of these solutions, however, require comprehensive sealing provisions against the sheet so that working fluid pressure buildup may be effectively achieved. Such seals are subject to heavy wear due to a relative movement between the tool and the sheet. Thus, the need for additional sealing provisions is a major drawback especially in large-scale sheet processing.

SUMMARY OF THE INVENTION

It is therefore an object of the present invention to provide an apparatus and a process for hydraulic high-pressure forming of a sheet to make it suitable for use in large-scale processing.

The present invention provides for high-speed hydraulic forming of sheets in a mechanical press which means that a sheet is formed using a press with an integrated pressure generating unit. By a continuous press ram movement, a top tool and/or a hold-down unit initially moves into contact with the sheet placed on the bottom tool to fix and simultaneously seal the latter. According to the invention the sheet is sealed relative to the tool solely by contact sealing, e.g., the respective tool surface planely and sealingly engages the sheet surface along the clamping area. Since the press has not yet reached its bottom dead center position by the time the tool is closed, the working or pressure fluid from the pressure generating unit is directed into the confined and/or sealed forming area above or below the sheet and preforming of the sheet is effected as the press descending movement continues. Subsequent sizing of the work piece is also accomplished via the working fluid or the tool (top and/or bottom tool).

It is possible, therefore, to achieve working fluid assisted forming within a very short cycle time and with just one tool movement. Sheet sealing is thus accomplished solely by contact between the top tool and/or the tool hold-down unit and the bottom tool with the sheet interposed therebetween. Since the pressure generating units arranged between the press ram and the top tool permit such a fast pressure buildup, even minor leakages across the sheet seals are acceptable as they have no negative impacts on the forming and/or sizing of the component.

The sealing efficiency is increased by using a working fluid of high viscosity because the fluid will escape slower from the sealing frame that is formed by contact sealing than a gas, such as air, would. High-viscosity oils, for example, may be used as working fluids.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
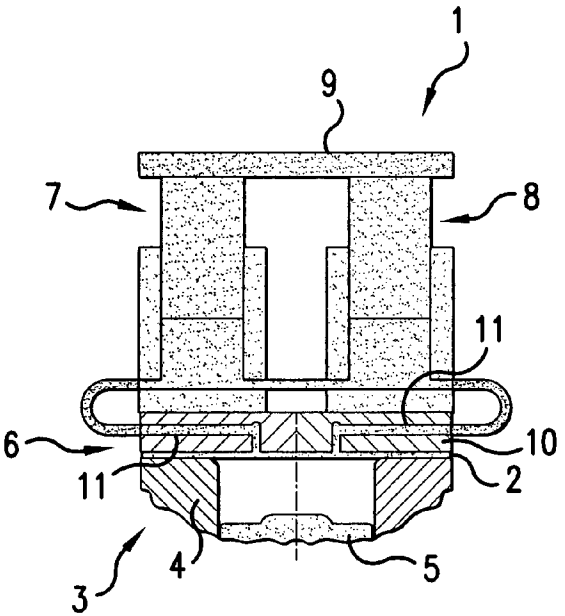
FIGS. 1–3 are schematic representations partly in the form of longitudinal sections which show a mechanical press for internal high-pressure forming of a sheet in various operating stages wherein the final forming step is effected with the aid of the hydraulic medium.
Figure 2:
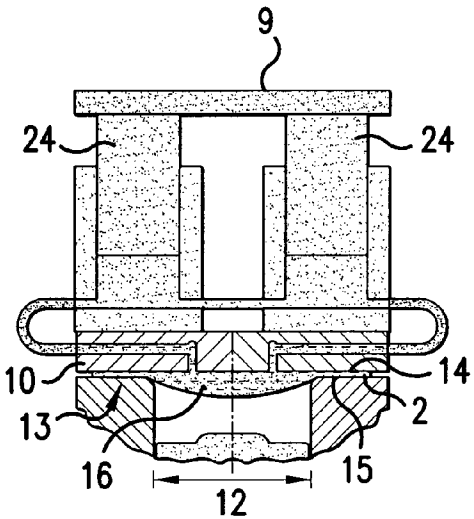
Figure 3:
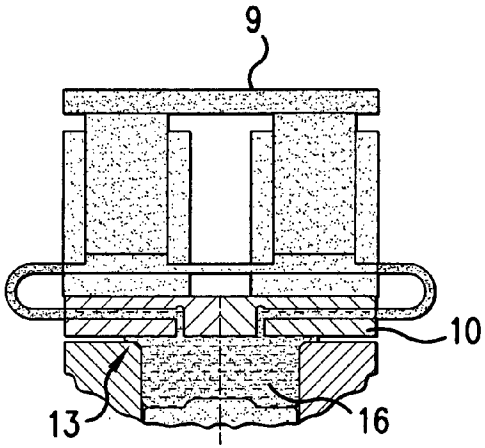

In FIGS. 1 to 3 the reference numeral 1 generally denotes an apparatus for hydraulic internal high-pressure forming of a sheet 2 and/or a sheet. The apparatus 1 comprises a bottom tool 3 having a drawing die 4 and an integrated female mold 5. On a side of a top tool 6 there are, for example, two pressure generating and/or piston/cylinder units 7, 8 disposed between the top tool 6 and the press ram 9 of a mechanical press such as an eccentric, crank, or toggle press in this example. There can be, however, also only one pressure generating unit. The top tool 6 includes a hold-down plate 10 extending across the entire sheet surface. Disposed in the hold-down plate 10 are inlet and/or outlet conduits 11 for the working fluid 16, which is provided from the pressure generating units 7, 8. The conduits 11 open toward the sheet surface within a forming area 12. The forming area 12 for the sheet 2 is surrounded by a clamping area 13 which is formed solely by contact faces 14 of the hold-down plate 10 on the sheet surface and contact faces 15 of the drawing die 4 on the opposite side of the sheet and which seals off the sheet against said forming area 12. The sheet 2 is deep-drawn by the working fluid 16, which can be of an especially high viscosity, and which enters the forming area 12 while the material underneath the hold-down unit within the contact faces keeps flowing into the bottom tool 3 at increasing rates (FIGS. 2 and 3).

Figure 6:
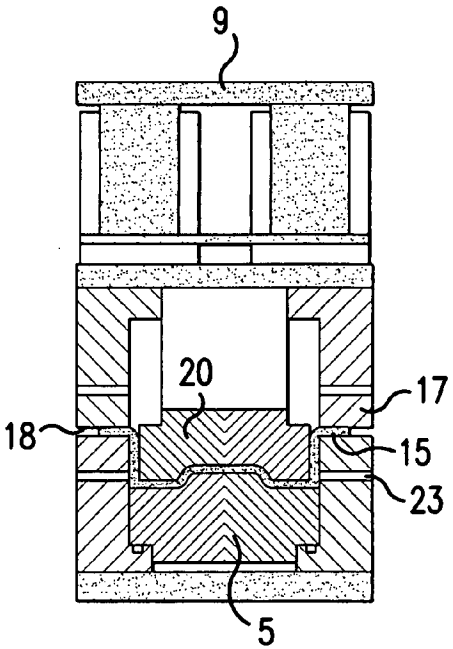
FIGS. 4–6 are schematic longitudinal sections of a mechanical press for internal high-pressure forming of a sheet in various operating stages wherein the final forming step is affected by means of the tool.
Figure 5:
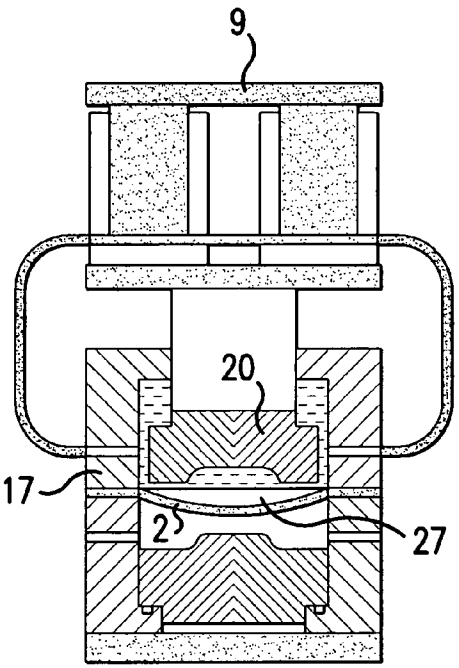
Figure 4:
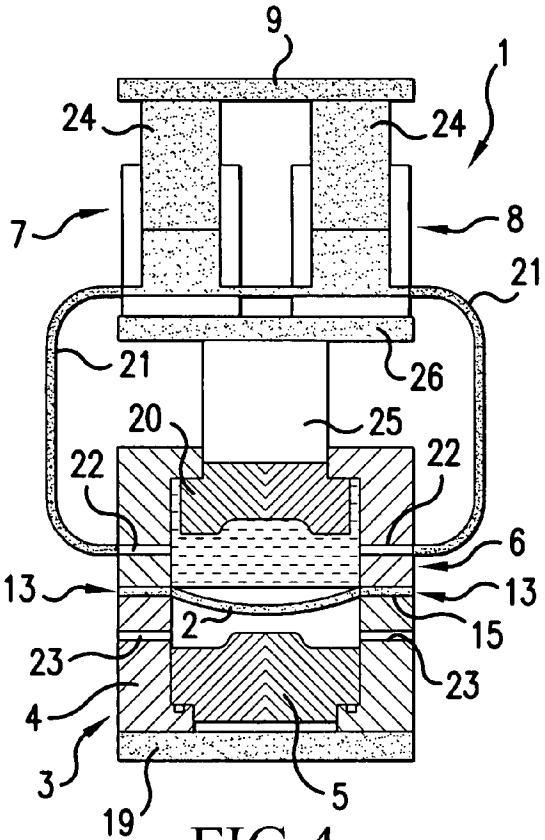

FIGS. 4 to 6 show a second embodiment of this present invention with identical reference numerals denoting identical components. In contrast to the first embodiment, the clamping area 13 for the sheet 2 is provided by a hold-down unit 17 of the top tool 6 having marginal contact faces 18, which are plane-parallel relative to the sheet surface. The bottom tool 3 is a drawing die 4 with integrated an female mold 5 disposed on a press platen 19. A punch 20 is movably arranged within the upper hold-down unit 17 and secured to a cylinder plate 26 of the pressure generating units 7, 8 by a punch holder 25. Working fluid feed and discharge conduits 21 respectively to and from the two pressure generating units 7, 8 are in communication with bores 22 in the hold-down unit 17 or bores 23 in the bottom drawing die 4.

The forming process takes place as follows: The sheet 2 is placed on the peripheral contact faces 15 of the bottom tool 3 and/or the drawing die and kept in position as well as clamped by the hold-down unit 10, 17 which descends while the press is closing. The press has not yet reached its bottom dead center position by the time the tool is closed so that while the press ram continues to descend, forming fluid is transferred by the pistons 24 via the conduits 11, 21 from the cylinder cavity of the piston/cylinder units 7, 8 to the surface 12 of the sheet 2 that is confined by the clamping area 13. A portion of the sheet starts to preform under the action of the pressure applied by the forming fluid; pressures in the range from 40 to 50 bar are sufficient to form the sheet by the hydraulic fluid.

The sheet 2 is preformed (FIG. 2) and can be subsequently pressed into its ultimate shape solely by the working fluid in this first process alternative.

In a second process alternative, the working fluid is only used for preforming the sheet 2 (FIG. 5). A first preforming step is carried out solely by the pressurized working fluid filling the forming area 27 above the sheet 2. Thereafter, the punch 20 is also moved down within the forming area 16, which is filled with working fluid, to assist the preforming operation. The working fluid is then extracted from the forming area 16 for the final forming step to take place in which the preformed component is pressed to the bottom die 5 and formed by the upper punch 20 (FIG. 6).

Due to the provision of the bores 23 in the bottom tool 3, a sheet can be formed to the opposite side toward the top tool, in which case a punch in the bottom tool would be moved upward against a die or a counter punch.

The apparatus and process as proposed permit to economically produce formed parts having short cycle times and with the sheet being sealed against the tool solely by contact.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for hydraulic high-pressure forming of a sheet, the apparatus comprising:

a top tool having a sheet contact face to contact with the sheet to fix and simultaneously seal the sheet;

a bottom tool having a sheet contact face; and at least one pressure generating unit being arranged between a press ram of a mechanical press and the top tool, a pressurized medium from the pressure generating unit being used as a working fluid for hydraulic forming of the sheet;

wherein the contact faces of the top tool and the bottom tool directly engage with a surface of the sheet along a clamping area thereof to thereby seal off a forming area that is subjected to the working fluid, by contact, and working fluid is used to effect forming of the sheet with one tool movement.

2. The apparatus according to claim 1, wherein the working fluid has a high viscosity.

3. The apparatus according to claim 1, wherein the top tool comprises a hold-down plate, which is in full-face contact with the sheet surface and plane-parallel therewith, and in which the working fluid conduits that are in communication with the respective pressure generating unit are integrated.

4. The apparatus according to claim 1, wherein the top tool comprises a hold-down means having marginal contact faces, which are plane-parallel to the sheet surface.

5. The apparatus according to claim 1, wherein the bottom tool comprises a drawing die with contact faces, which are plane-parallel to the surface of the sheet.

6. A method for hydraulic high-pressure forming of a sheet with a top tool and a bottom tool, in which at least one pressure generating unit is provided between the press ram of a mechanical press and the top tool, and in which the pressurized medium from the pressure generating unit is used as a working fluid for hydraulic forming of the sheet, the method comprising the steps of:

pressing together contact faces of the top tool and the bottom tool along a sheet clamping area to thereby retain the sheet in position;

sealing the sheet area that is subjected to the working fluid solely by contact between the contact faces of the top tool and the bottom tool; and preforming the sheet by the working fluid and forming a final shape of the sheet via sizing pressure of the working fluid or by the top tool or bottom tool with one tool movement.

7. The method according to claim 6, wherein a high-viscosity working fluid is applied to the sheet.

8. The method according to claim 6, wherein, at the time of performing the sheet by the pressurized medium, a punch is moved against a counter die or a counter punch of the opposite tool toward the preformed sheet, and wherein, the working fluid is subsequently removed from the forming area and the component is brought into the final shape by means of the punch.

9. An apparatus for hydraulic forming of a sheet, the apparatus comprising:

a top tool having an upper contact face;

a bottom tool having a lower contact face;

a forming area formed between the top tool and the bottom tool, the forming area including a recess that enables the sheet to be preformed by a pressurized hydraulic, wherein, during preforming of the sheet by the pressurized hydraulic the upper contact face directly engages a first surface of the sheet and the lower contact face directly engages a second surface of the sheet with one tool movement thereby forming a seal such that the pressurized hydraulic is substantially prevented from exiting the forming area.

10. The apparatus according to claim 9, wherein the recess is formed in either the top tool or the bottom tool.

11. The apparatus according to claim 9, wherein the pressurized hydraulic is provided by a pressure generating unit.

12. The apparatus according to claim 9, wherein the pressurized hydraulic is provided to the forming area via conduits that are formed in either the top tool or the bottom tool.

13. A method for forming a sheet, the method comprising the steps:

providing a sheet between an upper contact face of a top tool and a lower contact face of a bottom tool;

injecting a hydraulic fluid into a forming area formed between the top tool and the bottom tool, the forming area including a recess that enables the sheet to be formed by the hydraulic fluid;

sealing the forming area by moving the top tool and the bottom tool towards one another such that the upper contact face directly engages a first surface of the sheet and the lower contact face directly engages a second surface of the sheet with one tool movement, thereby substantially preventing the injected hydraulic fluid from exiting the forming area; and forming the sheet into a predetermined shape by the injected hydraulic fluid.

14. The method according to claim 13, wherein the hydraulic fluid is injected into the forming area via conduits that are provided in the top tool or the bottom tool.

15. The method according to claim 13, wherein the hydraulic fluid is injected into the forming area from a pressure generating unit.

* * * * *